US006324735B1

(12) United States Patent
Chen

(10) Patent No.: US 6,324,735 B1
(45) Date of Patent: Dec. 4, 2001

(54) BUCKLE DEVICE FOR SKATE BOOTS

(76) Inventor: Chin-Tsug Chen, No. 23, Alley 33, Lane 24, Sec. 3, Jungyang Rd., Lungjing Shiang, Taichung (TW)

( * ) Notice: Subject to any disclaimer, the term of this patent is extended or adjusted under 35 U.S.C. 154(b) by 0 days.

(21) Appl. No.: 09/488,935

(22) Filed: Jan. 21, 2000

(51) Int. Cl.[7] ..... A43C 11/00
(52) U.S. Cl. ..... 24/715 K; 24/68 SK
(58) Field of Search ..... 24/68 SK, 70 J, 24/68 J, 71 J, 715 K, 705 K, 265 WS; 36/50.5

(56) References Cited

U.S. PATENT DOCUMENTS 5,701,639 * 12/1997 Chen ..... 24/71 SK
5,720,084 * 2/1998 Chen ..... 24/68 SK
5,845,371 * 12/1998 Chen ..... 24/71 SK

* cited by examiner

*Primary Examiner*—Anthony Knight
*Assistant Examiner*—Ruth C. Rodriquez
(74) *Attorney, Agent, or Firm*—Rosenberg, Klein & Lee

(57) ABSTRACT

A buckle device for skate boots includes a U-shaped lock member pivotably connected to a frame on the boot and a head of a toothed belt is pivotably connected to the lock member. A slot is defined in a distal end of the lock member and two recesses defined in a bottom of the lock member. A tongue is retractably received in the slot of the lock member with two resilient legs biased between the tongue and an inside of the recess. The tongue has two limiting pieces movably retained in the two recesses in the lock member and an engaging member extends from a bottom of the tongue so as to be engaged with the hook. The lock member cannot be lifted except that the engaging member is disengaged from the hook by pushing the tongue.

2 Claims, 4 Drawing Sheets

BUCKLE DEVICE FOR SKATE BOOTS

FIELD OF THE INVENTION

The present invention relates to a buckle device for skate boots or in-line skate. The tongue of the buckle device has two resilient legs which is biased between the tongue and the inside of the recess in the lock member so as to retractably receive the tongue in the lock member.

BACKGROUND OF THE INVENTION

A conventional buckle device for skate boots or in-line skate generally includes a securing means on one flap of the boot and a lock member on the other flap of the boot, wherein the lock member is pivotably connected to a frame. A toothed belt has a first end thereof fixedly connected to a head pivotably connected to the lock member and a second end of the toothed belt can be secured in the securing means. The lock member is a U-shaped member and the frame and the head are pivotably connected to the lock member at different points. When fastening the belt, the first end of the belt is firstly secured in the securing means and then the lock member is pushed to pull the belt tightly. However, the lock member tends to be lifted unintentionally because there has no safety means connected to the lock member and once the buckle is opened, the ankle of the wearer could be hurt.

The present invention intends to provide a buckle device that has a tongue retractably received in the lock member so that the lock member cannot be lifted except that the tongue is first pushed.

SUMMARY OF THE INVENTION

In accordance with one aspect of the present invention, there is provided a buckle device for footwear. The buckle device comprises a frame on a first flap of the footwear and a hook extends from the frame. A U-shaped lock member includes a body portion with two arms and the lock member is pivotably connected to two lugs of the frame. Two recesses are defined in a bottom of the body portion and a slot is defined in a distal end of the body portion. The slot communicates with the two recesses. A toothed belt has a head on a first end thereof and the head is pivotably connected between the two arms of the lock member. A second end of the toothed belt is secured to the securing means. A tongue is retractably received in the slot and has two resilient legs. Two limiting pieces extend from a bottom of the tongue and are movably retained in the two recesses. An engaging member extends from the bottom of the tongue and the engaging member has an inclined surface which moves over the hook to force the tongue toward the resilient legs before the engaging member is engaged with the hook.

The object of the present invention is to provide a buckle device for footwear wherein two resilient legs extend from the tongue so that the tongue can be pushed toward the lock member to disengage the engaging member on the tongue from the hook on the frame.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
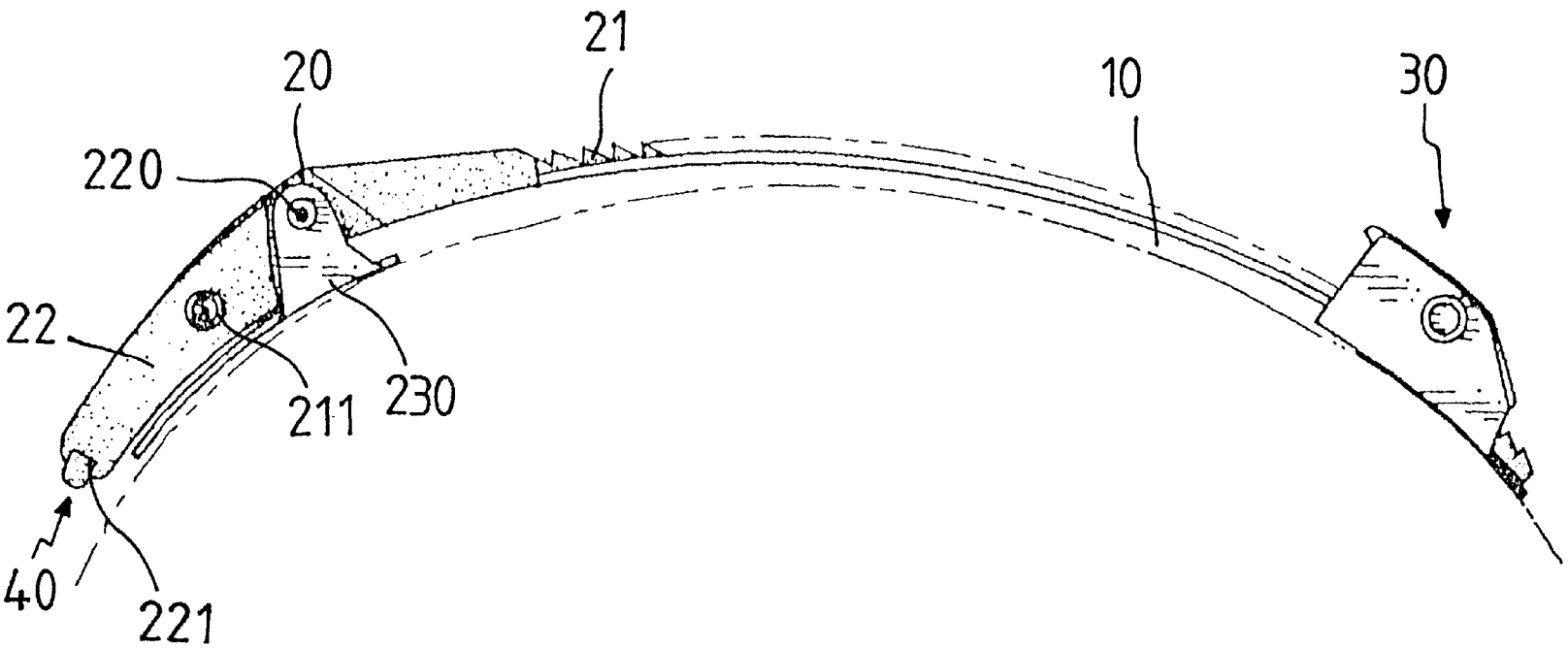
FIG. 1 is an illustrative view to show the buckle device of the present invention.
Figure 2:
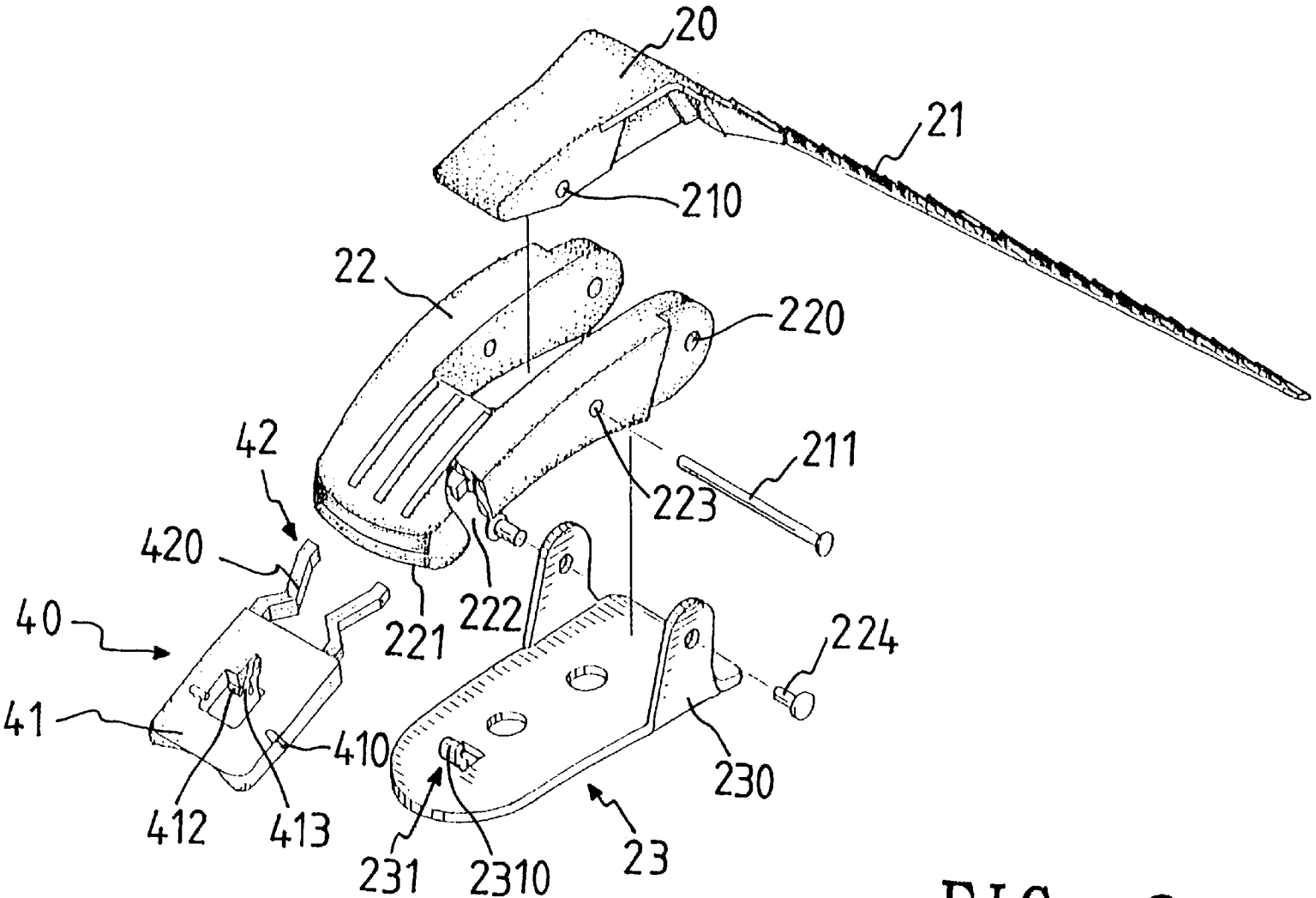
FIG. 2 is an exploded view to show the buckle device of the present invention.
Figure 4:
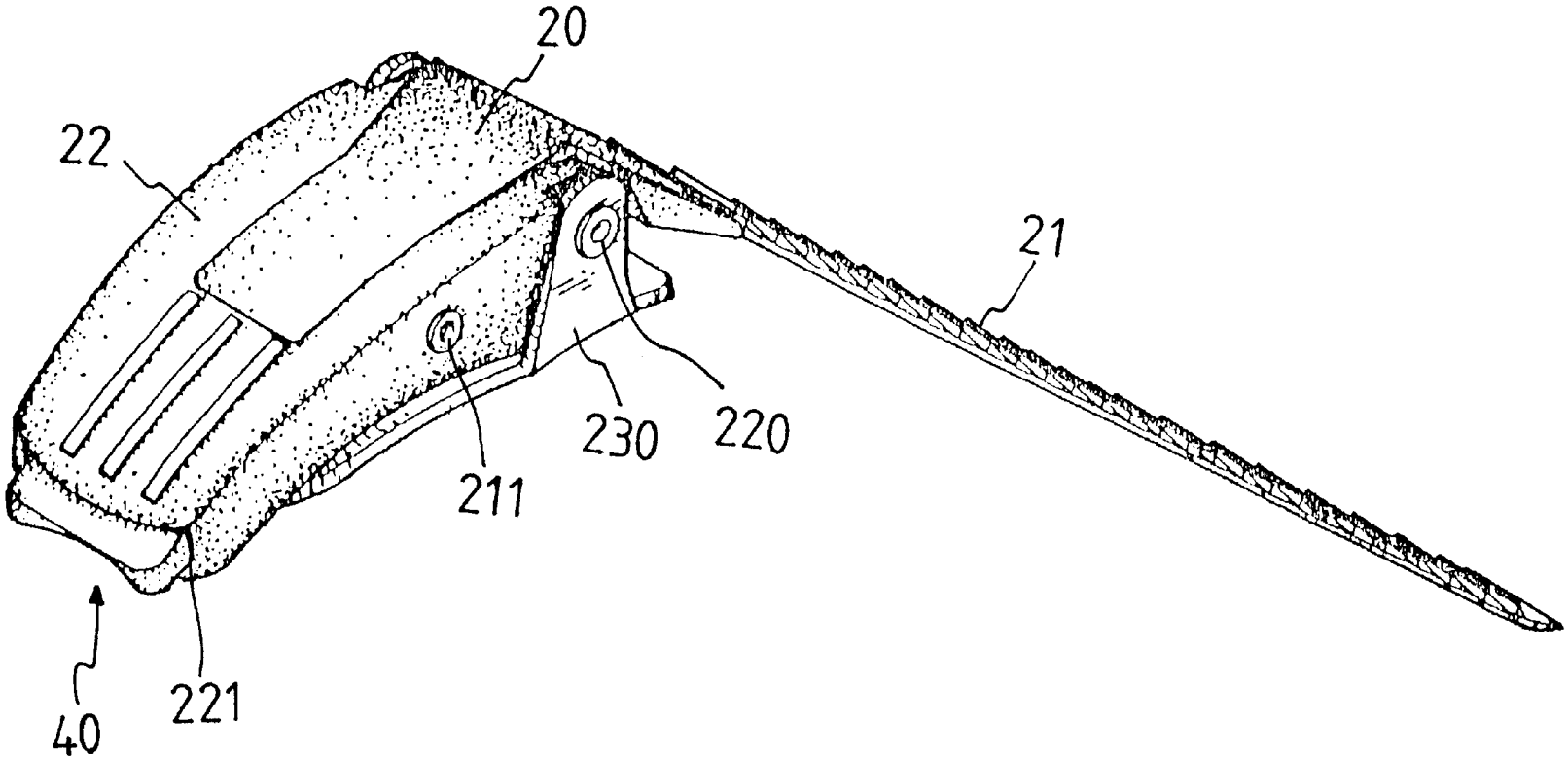
FIG. 4 is a perspective view to show the buckle device of the present invention.

Referring to FIGS. 1, 2 and 4, the buckle device in accordance with the present invention comprises a frame 23 fixedly connected on a first flap of a boot 10 or the like, and a securing means 30 fixedly connected to a second flap on the boot 10. The frame 23 has two lugs 230 extending therefrom and a hook 231 extends from the frame 23. The hook 231 has a rounded top 2310. A U-shaped lock member 22 includes a body portion and two arms extending from the body portion. Each arm of the lock member 22 has a first hole 220 and a second hole 223 respectively defined therethrough. The two arms of the lock member 22 are pivotably connected to the two lugs 230 of the frame 23 at the two first holes 220 by two pins 224. Two recesses 222 are defined in a bottom of the body portion and a slot 221 is defined in a distal end of the body portion. The slot 221 communicates with the two recesses 222.

A toothed belt 21 has a head 20 connected to a first end thereof and the head 20 is pivotably connected between the two arms of the lock member 22 at the two second holes 223 by a long pin 211 which passes through holes 210. A second end of the toothed belt 21 is to be secured to the securing means 30 by a known manner.

A tongue 40 is retractably received in the slot 221 and has two resilient legs 42 extending from a first end of the tongue 40. The resilient legs 42 urges against an inside of the slot 221 and each resilient leg 42 has at least one serrated section 420 so that it is convenient to be deformed. Two limiting pieces 410 extend from a bottom of the tongue 40 and are movably retained in the two recesses 222 of the lock member 22 when the tongue 40 is inserted in the slot 221. An engaging member 412 extends from the bottom of the tongue 40 and has an inclined surface 413. When the tongue 40 is inserted into the slot 221 of the lock member 22, a second end 41 extends from the slot 221.

Figure 3:
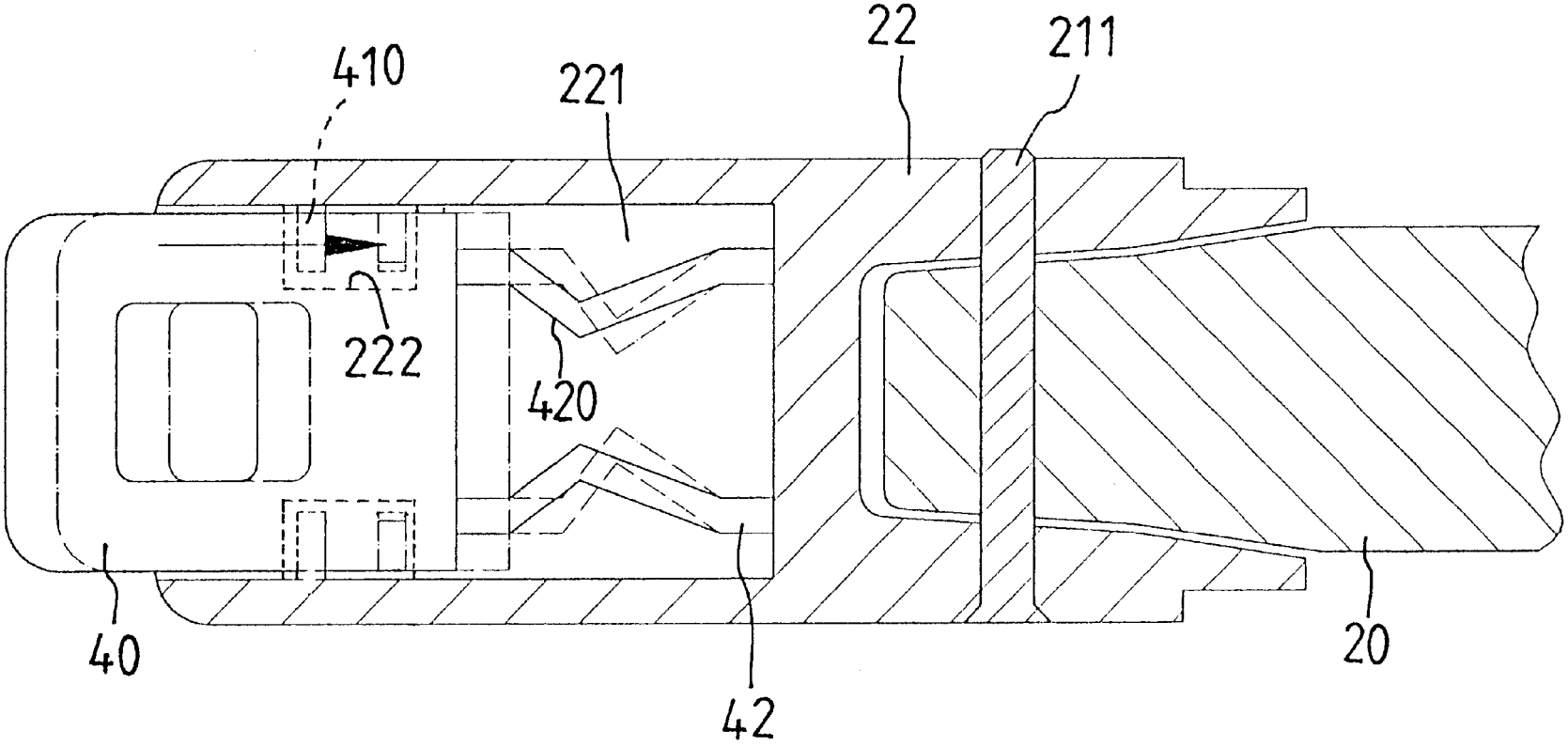
FIG. 3 is a top view to illustrate the operation of the tongue relative to the lock member of the buckle device of the of the present invention.

As shown in FIG. 3, when releasing the buckle device, the user has to push the second end of the tongue 40 to let the two resilient legs 42 be deformed and the tongue 40 is moved toward the lock member 22. Therefore, the engaging member 412 is moved away and disengaged from the hook 231, and the lock member 22 can be lifted. When locking the buckle device by pushing the lock member 22 toward the frame 23, the inclined surface 413 moves over the rounded top 2310 of the hook 231 to force the tongue 40 toward the resilient legs 42 and the engaging member 412 is engaged with the hook 231 after the inclined surface 413 of the engaging member 412 passes over the rounded top 2310 of the hook 231.

Accordingly, the buckle device has a safety feature that prevents the lock member 22 from being lifted if the tongue 40 is not pushed.

While we have shown and described various embodiments in accordance with the present invention, it should be clear to those skilled in the art that further embodiments may be made without departing from the scope and spirit of the present invention.

What is claimed is:

1. A buckle device for footwear having a first flap and a second flap on which a securing means is connected, said buckle device comprising:

a frame adapted to be fixedly on the first flap and having two lugs extending therefrom, a hook extending from said frame;

a U-shaped lock member including a body portion and two arms extending from said body portion, a first hole and a second hole respectively defined in each arm of said lock member, two recesses defined in a bottom of said body portion and a slot defined in a distal end of said body portion, said slot communicating with said two recesses, said two arms of said lock member pivotably connected to said two lugs of said frame at said two first holes of said two arms of said lock member;

a toothed belt having a head connected to a first end thereof and said head pivotably connected between said two arms of said lock member at said two second holes of said two arms of said lock member, a second end of said toothed belt adapted to be secured to the securing means, and a tongue retractably received in said slot and having two resilient legs extending from a first end of said tongue, each resilient leg having at least one serrated section, two limiting pieces extending from a bottom of said tongue and movably retained in said two recesses, an engaging member extending from said bottom of said tongue and said engaging member having an inclined surface which moves over said hook to force said tongue toward said resilient legs before said engaging member is engaged with said hook.

2. The buckle device as claimed in claim 1, wherein said hook has a rounded top.

* * * * *